US005180135A

United States Patent [19]

Hindall

[11] Patent Number: 5,180,135

[45] Date of Patent: Jan. 19, 1993

[54] PICTURE HANGER LOCATING DEVICE

[76] Inventor: Carey B. Hindall, 6218 Inverurie Dr., Dublin, Ohio 43017

[21] Appl. No.: 808,222

[22] Filed: Dec. 16, 1991

[51] Int. Cl.[5] ..... F16M 13/00

[52] U.S. Cl. ..... 248/544; 81/487; 248/475.1

[58] Field of Search ..... 248/475.1, 544, 467, 248/489, 493, 497, 494, 466; 81/487

[56] References Cited

U.S. PATENT DOCUMENTS

| | | | |
|---|---|---|---|
| 8,946 | 10/1879 | Pfeifer | 81/489 |
| D. 282,054 | 1/1986 | Hoffman | 248/544 X |
| 3,031,159 | 4/1962 | Waller | 248/544 X |
| 4,220,309 | 9/1980 | Eisen | 248/544 X |
| 4,437,639 | 3/1984 | Stein | 248/489 X |
| 4,517,860 | 5/1985 | Dameron | 81/487 |
| 4,637,583 | 1/1987 | Babitz | 248/497 X |
| 4,893,776 | 1/1990 | Floyd | 248/475.1 |

*Primary Examiner*—J. Franklin Foss
*Attorney, Agent, or Firm*—Thomas S. Baker, Jr.

[57] ABSTRACT

A picture hanger locating device supports a picture and has an integral marker for marking the location on a wall for affixing a picture hanger subsequent to the picture being moved to a desired position on the wall.

6 Claims, 2 Drawing Sheets

PICTURE HANGER LOCATING DEVICE

BACKGROUND OF THE INVENTION

Traditionally, pictures, mirrors and other framed objects having a generally flat back surface are hung from walls for decorative or functional purposes. In most cases these objects must be hung at a specific location on a wall to ensure artistic coordination between other items on the wall and objects within the room. One frequently used method of determining the proper location of an object being hung on a wall involves having one person hold the object with its back surface against the wall and moving the object along the surface of the wall until another person observes that the object has been optimally positioned.

Typically, an object being hung on a wall has a stretched wire attached to two points on the back surface thereof. Hanging the object involves placing the wire on a picture hanger which has been attached to the wall at an appropriate location. A picture hanger may be a straight line, single piece device such as a nail or other fastener attached to a wall or a two piece device with one piece having a hook for receiving a picture wire and an eye for receiving a fastener with the second piece being a fastener for securing the device to a wall. A two piece device also may have one piece such as a bracket adapted to be attached to the item being hung with the second piece being a fastener secured to a wall.

The location of a picture hanger may be determined by trial and error or by a series of measurements taken from a series of pencil marks placed on the wall adjacent the desired location for the object being hung. One disadvantage of the trial and error method resides in the fact that in most cases it becomes necessary to move the picture hanger a number of times thus leaving a plurality of marks on or holes in the wall. Alternatively, a series of measurements may be made once the desired location of an object has been determined which measurements will determine the precise location of the picture hanging device. Such measurements involve placing marks on the wall, are time consuming and involve some estimates including the amount the wire supporting the hung object may sag or stretch.

U.S. Pat. No. 4,517,860 to Dameron purports to disclose a tool for precisely locating a picture. The disclosed tool has a picture hanging projection at one end and a finger engaging flange at the opposite end. A person hangs the picture on the projection and moves the tool until the optimum picture position has been determined. Thereafter, the picture is removed from the hanger and the location of a picture hanger is marked by placing a mark on the wall through holes located adjacent the projection. Presumably, the picture hanging device would be located by attaching it at the location marked on the wall. This tool is somewhat difficult to manage in that the tool must be held in place while the picture is removed and the location marked, does not provide a simple means for marking the wall and does not address the fact that two piece picture hangers come in different sizes such the the distance between the fastener and the hook for different sized hangers is not uniform.

From the above, it may be observed that it is desirable to provide a picture hanger locating device which is simple, accurate, does not leave extraneous marks on the wall, which is self contained in that it has an integral marking means which works with single piece and two piece hangers and which accommodates different sizes of two piece hangers.

SUMMARY OF THE INVENTION

A picture hanger locating device has a main body member with a top surface, a bottom surface, a pair of side surfaces, a substantially flat back side adapted to engage a wall and a front side. A handle is attached to the front side of the body member. A downwardly depending positioning arm having an upper end and a lower end is movably attached to the bottom surface of the body member such that the lower end of the arm is movable between a rest position and a marking position. The positioning arm has a front surface and a rear surface. The device includes a marking means for marking the location of a picture hanger when the arm has been moved to the marking position attached to the rear surface of the positioning arm. Additionally, mounting means for mounting a picture hanger are attached to the front surface of the positioning arm.

DESCRIPTION OF THE PREFERRED EMBODIMENT

Figure 1:
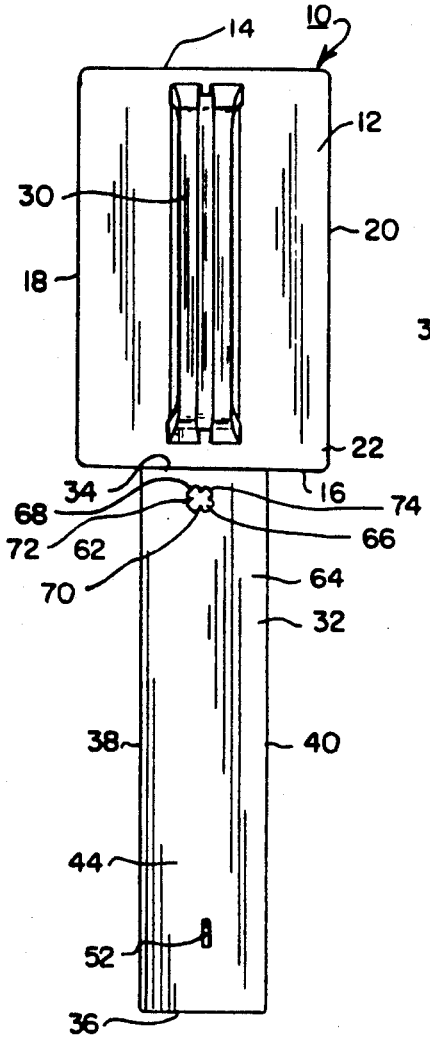
FIG. 1 is a front view of the picture hanger locating device in the present invention.
Figure 2:
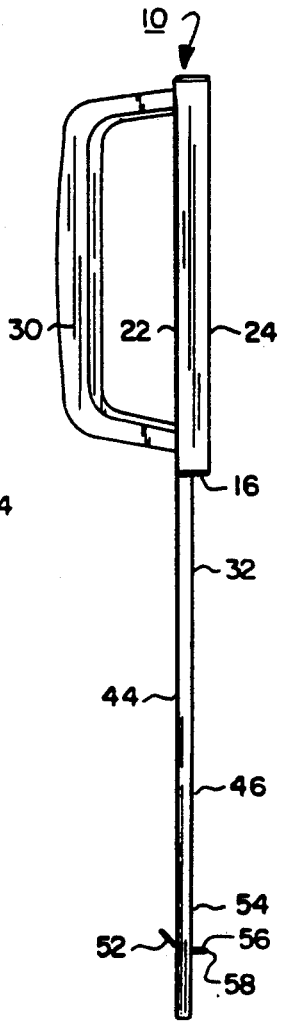
FIG. 2 is a side view of the subject picture hanger locating device.
Figure 3:
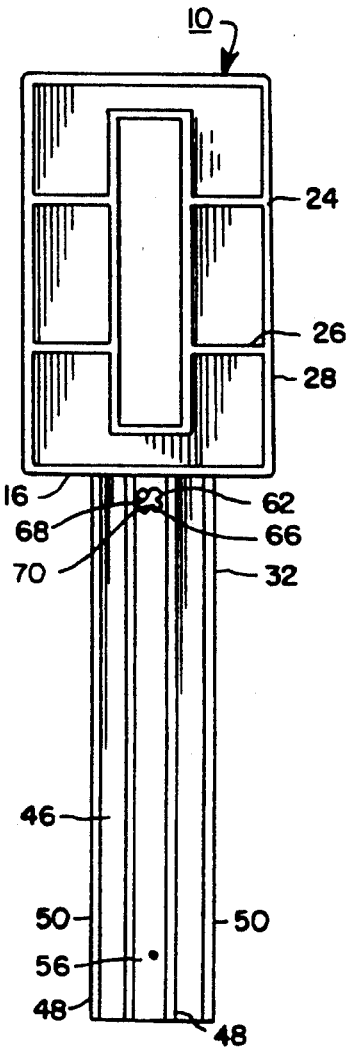
FIG. 3 is a rear view of the picture hanger locating device of the subject invention.
Figure 4:
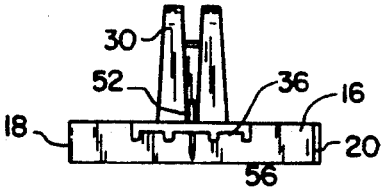
FIG. 4 is a bottom view of the picture hanger locating device.
Figure 5:
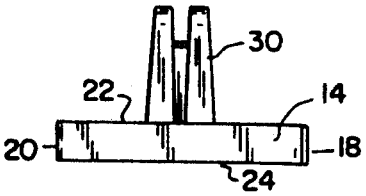
FIG. 5 is a top view of the picture hanger locating device.

Turning to FIGS. 1 through 3 of the drawings, it may be observed that the picture hanger locating device (10) of the present invention has a rectangular main body member (12) having a top surface (14), a bottom surface (16) and a pair of side surfaces (18 and 20). A substantially flat front side (22) and a generally flat back side (24) further define main body member (12). Turning to FIG. 3, it may be seen that back side (24) has a plurality of ribs (26). Back side (24) has been described as substantially flat meaning that the top surface (28) of the ribs (26) which define back side (24) are in a common plane which extends parallel to that of front side (22). When the picture hanger locating device (10) is in use, the back side (24) is placed against the surface of a flat wall.

A handle (30) best shown in FIGS. 1 and 2 is mounted on main body member (12) between top surface (14) and bottom surface (16) and spaced approximately the same distance from each of the side surfaces (18 and 20). Turning again to FIGS. 1 through 3, it may be seen that the picture hanger locating device (10) has a downwardly depending generally rectangular positioning arm (32) movably connected to the bottom surface (16) of main body member (12) such that arm (32) may be deflected or pivoted with respect to member (12) as will be discussed in greater detail hereinbelow. Positioning arm (32) is defined partially by a top edge (34) connected to the bottom surface (16) of body member (12), a bottom edge (36) and a pair of side edges (38 and 40).

Also, positioning arm (32) has a generally flat front surface (44) and a flat ribbed rear surface (46). Rear surface (46) is defined by a plurality of ribs (48) having top surfaces (50) which are parallel to each other such that the surfaces (50) extend in a plane which is parallel to the plane of front surface (44). For purposes of this description, references to the rear surface (46) of positioning arm (32) will refer to the top surfaces (50) of ribs (48). Ribs (48) are formed in position arm (32) inasmuch as arm (32) is illustrated as having a plastic molded construction the same as main body member (12). In fact, positioning arm (32) preferably is constructed as an integral molded piece with main body member (32).

Turning to FIG. 2, it may be seen that a pilot hook (52) for mounting a picture wire or a picture hanger projects at an upward angle from the front surface (44) of the lower end (54) of positioning arm (32) and a marking tip (56) projects outwardly from the rear surface (46) of positioning arm (32). Marking tip (56) which may be a small diameter metal piece having a sharpened tip projects perpendicularly from rear surface (46). It should be noted that the plane of rear surface (46) is parallel to and intermediate the planes of the front and back sides (22 and 24) of positioning arm (32). Also, it should be noted that although marking tip (56) projects laterally from rear surface (46) the outer end (58) of marking tip (56) does not project beyond the plane of the back side (24) of body member (12) when positioning arm (32) is in the rest position depicted in FIGS. 1, 2, 3 and 7. Thus, when positioning arm (32) is in the at rest position the outer end (58) of marking tip (56) is spaced from the surface (60) of a wall when the back side (24) of body member (12) rests against a wall as seen best in FIG. 7 and as will be described in greater detail hereinbelow.

Turning to FIGS. 1 and 3, it may be seen that positioning arm (32) incorporates a vertical and horizontal alignment gage (62) at its upper end (64). Alignment gage (62) enables an operator to align positioning arm (32) with a vertical line or a horizontal line on a wall. Alignment gage (62) has a central through opening (66) and a first pair of points (68 and 70) located one hundred eighty degrees apart to enable an operator to align positioning arm (32) with a line on a wall which may be seen through central opening (66). Proper vertical alignment of positioning arm (32) would be achieved when a vertical line on a wall with which the arm (32) is to be aligned is shown as passing through the points (68 and 70). Similarly, a pair of points (72 and 74) spaced one hundred eighty degrees apart and ninety degrees apart from points (68 and 70) provide a means for alignment of positioning arm (32) with a horizontal line on a wall. Arm (32) would be aligned perpendicular to a horizontal line on a wall when the line viewed through opening (66) passes through points (72 and 74).

Use of the picture hanger locating device (10) of the present invention now will be described in connection with reference to FIGS. 6 and 7. A picture (80) has a wire (82) attached at two points (84) on its back side (86). The picture (80) is mounted on the pilot hook (52) at the lower end (54) of positioning arm (32) by placing wire (82) over hook (52). In this instance, the picture hanger locating device (10) will determine the precise location of a straight line hanging device such as a nail or threaded fastener which will be affixed to a wall to mount picture (80). Thus, the nail or other straight line hanging device would be the picture hanger. Alternatively, if it is desired to utilize a two piece picture hanger assembly having a hook and eye affixed to a wall by a nail, screw or other type of fastener, the hook and eye piece would be mounted on pilot hook (52) by passing the hook through the hanger eye. Thereafter the picture wire (82) would be passed over the hanger hook. In this instance the picture hanger locating device (10) would precisely locate the position of a fastener which would be attached to the wall (60) to support the hook and eye member. Also, where a two piece picture hanger assembly having a bracket affixed to the item being hung is utilized the bracket is mounted on the pilot hook (52) and the picture hanger locating device (10) determines the proper location for a straight line hanging device in the same manner as if a wire is used.

Figure 6:
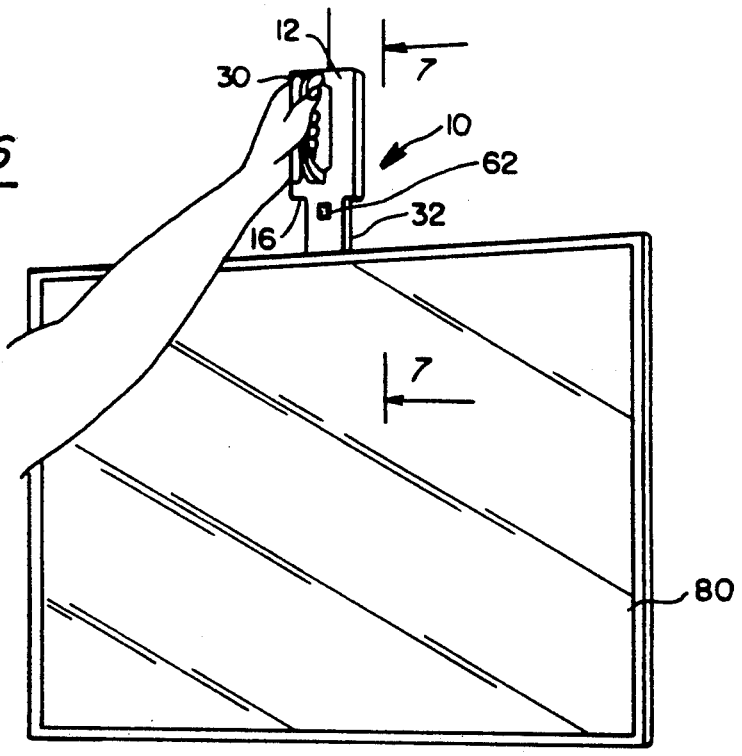
FIG. 6 shows a picture mounted on the picture hanger locating means of the subject invention.
Figure 7:
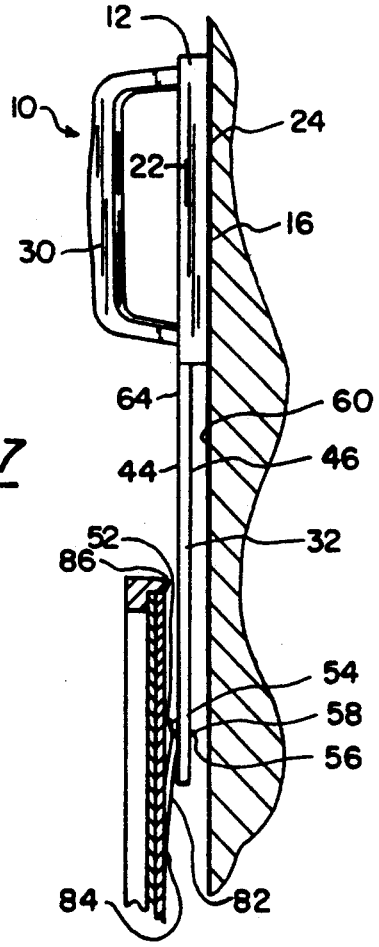
FIG. 7 is a view along lines 7—7 of FIG. 6.

As previously mentioned, the description in connection with FIGS. 6 and 7 will describe the method used to determine the wall (60) location of a straight line hanging device such as a nail or screw.

Subsequent to picture (80) being mounted on pilot hook (52) an operator grasping the handle (30) on main body member (12) moves the picture hanger locating device (10) to cause the back side (24) of main body member (12) to rest against wall (60). Thereafter, the operator moves the locating device (10) and picture (80) until the optimum position of picture (80) has been determined. During this time the positioning arm (32) of locating device (10) remains in the at rest position depicted in FIGS. 1, 2, 3 and 7 and the marking tip (56) remains spaced from the wall (60). When the picture (80) has been properly positioned on the wall, the operator applies his hand to the front surface (44) of positioning arm (32) or to the front face of picture (80) to cause the lower end (54) of arm (32) to move toward the surface of wall (60) and cause the outer end (58) of marking tip (56) to contact wall (60) and apply a mark thereon.

As mentioned above, (10) the position arm (32) is movably attached to the bottom surface (16) of main body member (12). Preferably, locating device (10) is constructed as a unitary, plastic object with positioning arm (32) being sufficiently resilient to enable the lower end (54) to deflect with respect to the upper end (64) to enable marking tip (56) to engage a wall. Alternatively, main body member (12) and positioning arm (32) could be constructed as two separate pieces with the upper end (64) of arm (32) pivotally attached to the bottom surface (16) of main body member (12). In any event, the picture hanger locating device (10) should be constructed such that positioning arm (32) has an at rest position such that marking tip (56) is spaced from the surface of wall (60) when an operator moves main body member (12) against the surface of a wall (60) and slides the back side (24) of body member (12) across the wall to attain the proper position for a picture. Thereafter, the position arm (32) should be capable of being moved to a marking position in which the outer end (58) of marking tip (56) engages a wall surface to affix a mark thereto. After the picture hanger locating device (10) has been used to determine the proper location for a picture hanger, the one piece straight line picture hanger or the nail or other fastener for a two piece hanger with one piece being a hook and eye is driven into the wall at the location marked by locating device (10). It should be noted that the picture does not have to be removed from the device (10) when the wall is marked.

Since certain changes may be made in the above-described system and apparatus not departing from the scope of the invention herein and above, it is intended that all matter contained in the description or shown in the accompanying drawings shall be interpreted as illustrative and not in a limiting sense.

We claim:

1. A picture hanger locating device which comprises:

a main body member having a top surface, a bottom surface, a pair of side surfaces, a substantially flat back side adapted to engage a wall and a front side;

a handle attached to the front side of said body member;

a movable downwardly depending positioning arm having an upper end and a lower end movably attached to the bottom surface of said body member such that the lower end of said arm is movable between a rest position and a marking position;

said positioning arm having a front surface and a rear surface;

wherein the plane of said rear surface of said positioning arm is intermediate the planes of said front side and said back side of said body member when said arm is at said rest position;

marking means for marking the location of a picture hanger when said arm is at said marking position fixedly attached to the lower end of said positioning arm;

wherein said marking means is located between said positioning arm rear surface and the plane of said back side of said main body member when the lower end of said arm is at said rest position and extends beyond the plane of said back side of said main body member when the lower end of said arm is at said marking position; and mounting means for mounting a picture attached to the front surface of said positioning arm.

2. The picture hanger locating device of claim 1 further comprising vertical alignment means for positioning said marking tip along a vertical line mounted on said positioning arm intermediate said marking tip and the bottom surface of said main body member.

3. The picture hanger locating device of claim 2 further comprising horizontal alignment means for positioning said marking tip parallel to a horizontal line on a wall.

4. The picture hanger locating means of claim 1 in which said main body member and said positioning arm are a unitary integral molded part.

5. The picture hanger locating means of claim 4 in which said molded part is constructed out of plastic.

6. The picture hanger locating means of claim 1 in which said handle is positioned on said main body member intermediate said top surface and said bottom surface and intermediate said side surfaces.

* * * * *